US008069925B2

(12) United States Patent
Obrejanu

(10) Patent No.: US 8,069,925 B2
(45) Date of Patent: Dec. 6, 2011

(54) DOWNHOLE RESETTABLE CLUTCH SWIVEL

(75) Inventor: Marcel Obrejanu, Calgary (CA)

(73) Assignee: Star Oil Tools Inc., Calgary, Alberta (CA)

( * ) Notice: Subject to any disclaimer, the term of this patent is extended or adjusted under 35 U.S.C. 154(b) by 257 days.

(21) Appl. No.: 11/983,167

(22) Filed: Nov. 7, 2007

(65) Prior Publication Data

US 2009/0114400 A1 May 7, 2009

(51) Int. Cl.
*E21B 17/05* (2006.01)
*E21B 23/00* (2006.01)

(52) U.S. Cl. ..... 166/382; 166/237; 166/242.6

(58) Field of Classification Search ..... 166/382, 166/237, 242.6
See application file for complete search history.

(56) References Cited

U.S. PATENT DOCUMENTS

| | | | | | |
|---|---|---|---|---|---|
| 3,100,538 | A | * | 8/1963 | Sanders | 166/237 |
| 3,158,201 | A | * | 11/1964 | Springer | 166/120 |
| 3,433,301 | A | * | 3/1969 | Mcever, Jr. | 166/128 |
| 3,494,417 | A | * | 2/1970 | Fredd | 166/73 |
| 3,552,492 | A | * | 1/1971 | Mullins | 166/237 |
| 4,030,546 | A | * | 6/1977 | Rogers et al. | 166/208 |
| 4,051,899 | A | * | 10/1977 | Fredd | 166/217 |
| 4,127,168 | A | * | 11/1978 | Hanson et al. | 166/123 |
| 4,564,068 | A | * | 1/1986 | Baugh | 166/123 |
| 4,577,685 | A | * | 3/1986 | Eatwell | 166/115 |
| 4,593,765 | A | * | 6/1986 | Greenlee | 166/387 |
| 4,625,798 | A | * | 12/1986 | Bayh, III | 166/106 |
| 4,658,895 | A | * | 4/1987 | Brisco | 166/237 |
| 4,726,425 | A | * | 2/1988 | Smith, Jr. | 166/387 |
| 4,749,341 | A | * | 6/1988 | Bayh, III | 417/360 |
| 4,913,239 | A | * | 4/1990 | Bayh, III | 166/385 |
| 5,642,782 | A | | 7/1997 | Grimshaw et al. | |
| 5,836,396 | A | | 11/1998 | Norman et al. | |
| 6,131,663 | A | * | 10/2000 | Henley et al. | 166/373 |
| 6,467,547 | B2 | * | 10/2002 | Maguire et al. | 166/386 |
| 7,011,162 | B2 | * | 3/2006 | Maguire | 166/382 |
| 2004/0094309 | A1 | * | 5/2004 | Maguire | 166/381 |
| 2009/0114400 | A1 | * | 5/2009 | Obrejanu | 166/381 |

OTHER PUBLICATIONS

Canadian Office Action for Canadian Patent Application No. 2,643,041 mailed Sep. 27, 2010. 2 pages.

* cited by examiner

*Primary Examiner* — Jennifer H Gay
(74) *Attorney, Agent, or Firm* — Wilmer Cutler Pickering Hale and Dorr LLP

(57) ABSTRACT

A top sub of a clutch swivel for connection to a production well tubing string is movable between an engaged position and a disengaged position relative to a mandrel. The engaged position allows an anchor to be set in a well casing by rotating the tubing string. Tension can be applied to the tubing string to move the top sub to the disengaged position, allowing the tubing string to be rotated without rotating the mandrel. The anchor can be moved to a different position, without pulling the tubing string to the surface, by removing tension from the tubing string to move the top sub from the disengaged position to the engaged position, rotating the tubing string in an opposite direction to release the anchor, and resetting the anchor by again rotating the tubing string. The top sub may also include a sealed internal volume of the swivel remains constant are.

19 Claims, 8 Drawing Sheets

DOWNHOLE RESETTABLE CLUTCH SWIVEL

FIELD OF THE INVENTION

This invention relates generally to downhole equipment for production wells and, in particular, to a resettable clutch swivel.

BACKGROUND

Tubing swivels are used in production wells to reduce the effects of erosion at a point of contact between a sucker rod string and an inside surface of a production tubing string. A tubing rotator that is installed at the surface, as part of a wellhead, slowly turns the tubing string from the surface all the way to the tubing swivel installed above the downhole pump. Tubing rotators typically turn the tubing string to the right (right hand rotation).

Depending on the pump being used, the anchoring system that is required, and the specific completion requirements of a particular well, there are three kinds of swivels that can be used: a two way swivel, a one way swivel, and a clutch swivel. The two way swivel is used in applications where Progressive Cavity (PC) pumps are anchored with torque anchors that do not require left hand rotation to be released. The one way swivel is used in applications where PC pumps or piston pumps are used, and they are anchored with torque anchors or right hand set tension and require left hand rotation to be released. The clutch swivel is used in applications where piston pumps are used, and they are anchored with left hand set tension anchors that require right hand rotation to be released.

One common type of clutch swivel is the shear type clutch swivel. U.S. Pat. No. 5,642,782 describes a shear type clutch swivel and U.S. Pat. No. 5,836,396 describes a method of operating a downhole shear type swivel. A disadvantage of shear type clutch swivels is that if the anchor is set in the wrong place or not enough tension can be pulled in the tubing string and the anchor has to be moved, the whole downhole assembly has to be pulled back to surface. The shear clutch swivel has to be re-dressed (the shear pins have to be replaced with new ones), and then the whole assembly is run back into position.

Another disadvantage of existing tubing swivels relates to sealing of swivel components from the production well. In some tubing swivels, components of the swivel are not sealed from the production well, allowing well fluids, sand, etc., to contact the swivel components. Movement of swivel components relative to each other in a sealed swivel tends to create suction, which can similarly pull well fluids and other contaminants into a sealed area of the swivel. Such contaminants can affect operation of tubing swivels.

SUMMARY OF THE INVENTION

Embodiments of the present invention address one or more of the disadvantages noted above. Some embodiments allow a clutch swivel to be reset and an anchor to be moved to a different position without having to pull the swivel to the surface. An improved sealing arrangement is also provided.

According to one aspect of the invention, a downhole resettable clutch swivel includes a top sub for connection to a tubing string of a production well, the top sub comprising a clutch mechanism; a mandrel; and a retaining arrangement that: releasably retains the top sub in an engaged position in which the clutch mechanism engages the mandrel to rotate the mandrel with the tubing string for setting or releasing a downhole anchor, and allows the top sub to be moved between the engaged position and a disengaged position in which the clutch mechanism disengages the mandrel to enable the tubing string to be rotated relative to the mandrel.

The clutch mechanism may include a lug for engaging a complementary lug of the mandrel.

In some embodiments, the retaining arrangement includes a collet, which includes fingers for releasably engaging a shoulder on the mandrel to retain the top sub in the engaged position.

The retaining arrangement may include a housing for sealing an internal space of the clutch swivel from the production well between the housing, the top sub, and the mandrel. A volume of the sealed internal space remains constant in the engaged position, the disengaged position, and during movement of the top sub therebetween in some embodiments.

Such a housing may include a protrusion for releasably holding the fingers in a groove defined by the shoulder.

In some embodiments, the housing includes a bottom cap, which includes the protrusion.

The clutch swivel may also include a first spring that moves the retaining arrangement from a first position in which the top sub is retained in the engaged position to a second position in which the top sub is in the disengaged position.

The first spring may be disposed between a first shoulder of the housing and a first shoulder of the collet, and move the collet from the first position in which the top sub is retained in the engaged position to the second position in which the top sub is in the disengaged position. The first shoulder may be provided on a bottom cap of the housing, for example.

A second spring may be used to move the retaining arrangement from the second position to the first position. In one embodiment, the second spring is disposed between a second shoulder of the housing and a second shoulder of the collet, and moves the collet from the second position to the first position.

The clutch swivel may be implemented, for example, in a production well completion system that also includes the tubing string connected to the top sub; and downhole equipment comprising the anchor connected to the mandrel.

A method is also provided, and involves connecting a clutch swivel assembly to a tubing string of a production well, the clutch swivel assembly comprising a top sub for connection to the tubing string of a production well, a mandrel, and a retaining arrangement that releasably retains the top sub on the mandrel in an engaged position in which a clutch mechanism of the top sub engages the mandrel and allows the top sub to be moved between the engaged position and a disengaged position in which the clutch mechanism disengages the mandrel; connecting an anchor to the mandrel; rotating the tubing string in a first direction with the top sub in the engaged position to set the anchor at a first downhole position in a production well; applying tension to the tubing string to move the top sub from the engaged position to the disengaged position; removing tension from the tubing string to move the top sub from the disengaged position to the engaged position; rotating the tubing string in a second direction opposite to the first direction with the top sub in the engaged position to release the anchor; moving the anchor from the first downhole position to a second downhole position, with the clutch assembly and the anchor remaining downhole during the moving; and rotating the tubing string in the first direction with the top sub in the engaged position to reset the anchor at the second downhole position.

The method may also include rotating the tubing string with the top sub in the disengaged position.

Another aspect of the invention provides a downhole clutch swivel that includes: a mandrel; a top sub for connection to a tubing string of a production well, the top sub comprising a clutch mechanism that engages the mandrel to rotate the mandrel with the tubing string, and disengages the mandrel to enable the tubing string to be rotated relative to the mandrel; and a housing for sealing an internal volume from the production well between the housing, the top sub, and the mandrel, the internal volume remaining constant when the top sub engages the mandrel, disengages the mandrel, and is moved between engaging and disengaging the mandrel.

The housing may include respective seals for sealing the housing against the top sub and against the mandrel.

In some embodiments, the housing includes a main body comprising a seal for sealing the housing against the top sub; and a bottom cap comprising a first seal for sealing the bottom cap against the mandrel and a second seal for sealing the main body against the bottom cap, and the top sub includes a seal for sealing the top sub against the mandrel.

The clutch swivel may also include first set screws for securing a first threaded connection between the main body and the top sub; and second set screws for securing a second threaded connection between the main body and the bottom cap. The first seal of the bottom cap for sealing the bottom cap against the mandrel and the seal of the top sub for sealing the top sub against the mandrel have a common inside diameter in some embodiments.

Other aspects and features of embodiments of the present invention will become apparent to those ordinarily skilled in the art upon review of the following description.

BRIEF DESCRIPTION OF THE DRAWINGS

Examples of embodiments of the invention will now be described in greater detail with reference to the accompanying drawings.

DETAILED DESCRIPTION OF PREFERRED EMBODIMENTS

Figure 1:
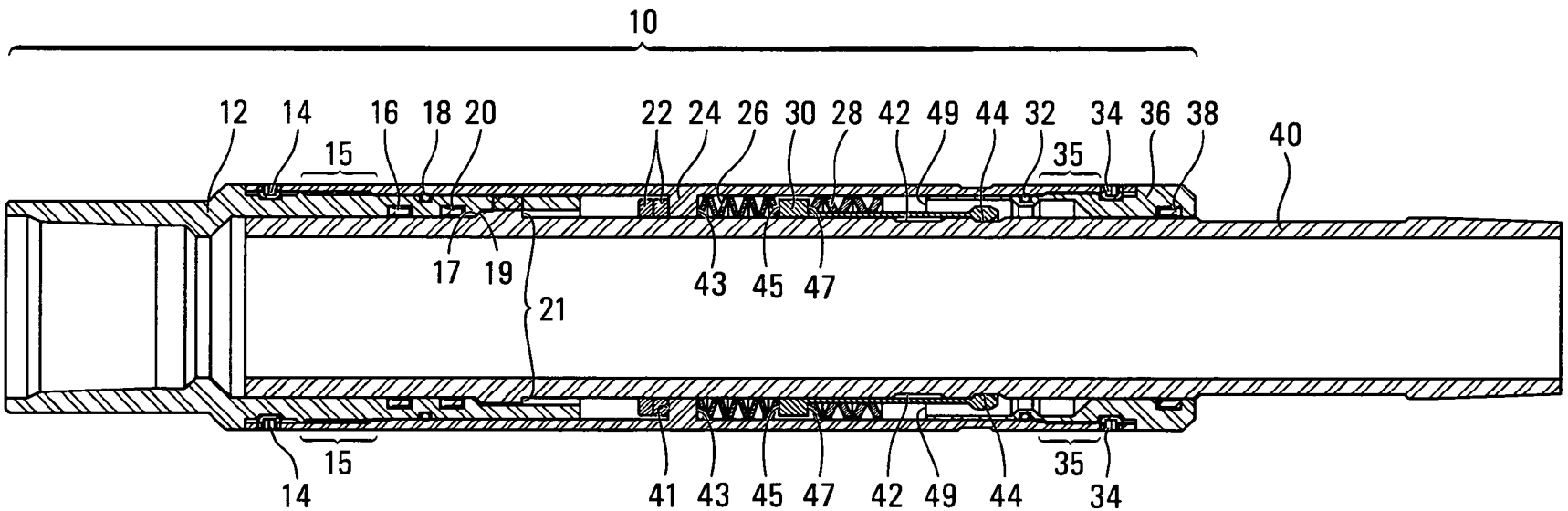
FIG. 1 shows a cross-section of a clutch swivel.
Figure 2:
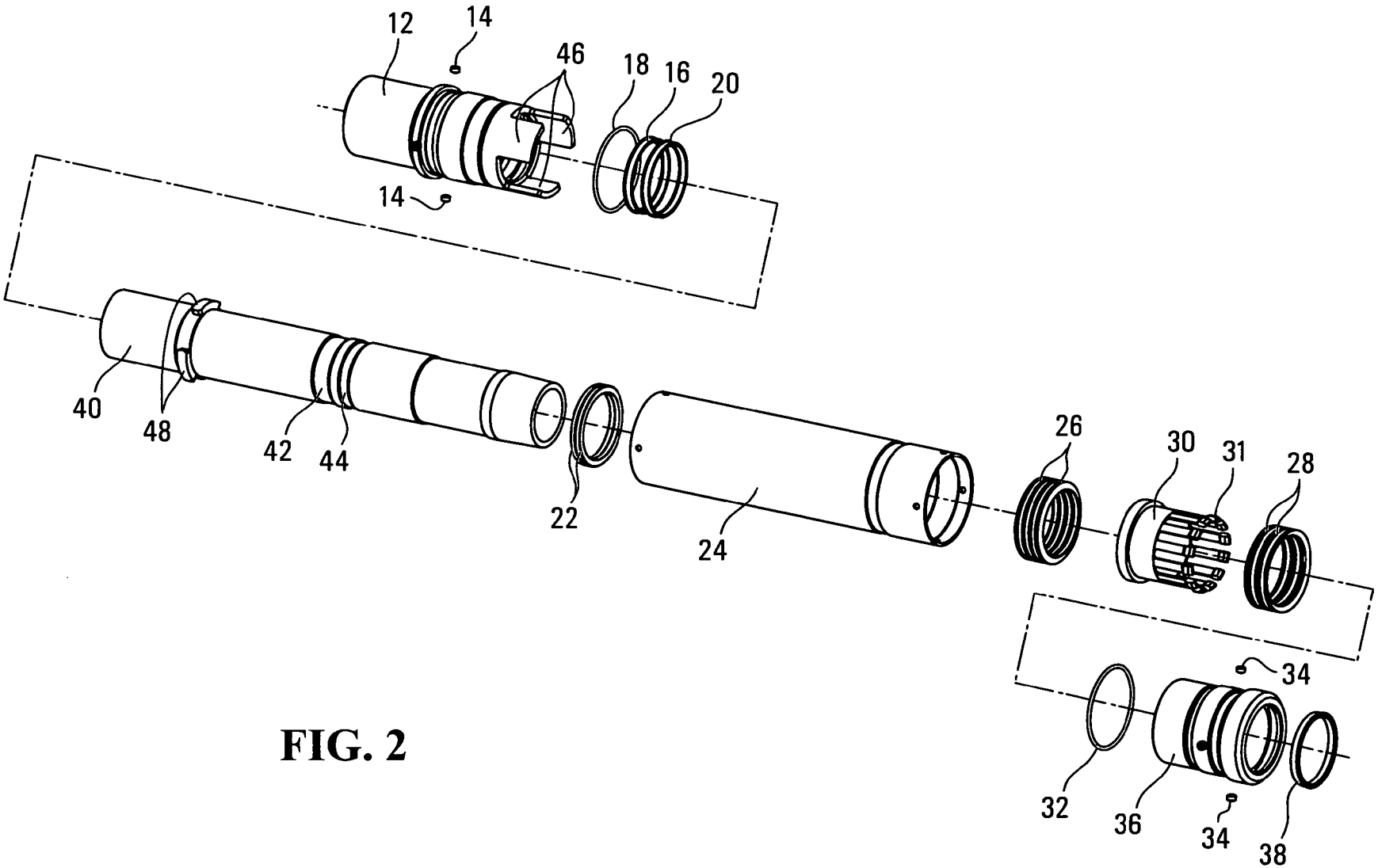
FIG. 2 is an exploded view of the clutch swivel of FIG. 1.

FIG. 1 shows a cross-section of a clutch swivel according to an embodiment of the invention, and FIG. 2 is an exploded view of the clutch swivel of FIG. 1. The structure of the clutch swivel is described below with reference to both FIGS. 1 and 2, and its operation will be described primarily with reference to the subsequent Figures.

It will be apparent that the Figures and the description below concentrate primarily on components of a clutch swivel. Those skilled in the art will be familiar with production wells, tubing strings, and anchors, as well as surface and downhole equipment in conjunction with which a clutch swivel may be used.

As shown in FIGS. 1 and 2, the example clutch swivel 10 includes a top sub 12 that connects to a tubing string above in a production well (not shown). The top sub 12 includes, as one possible implementation of a clutch mechanism, a set of lugs 46 milled out on its lower side for engaging a complementary set of lugs 48 milled out of a shoulder 21 on a mandrel 40. As described in further detail below, the lower surface of the shoulder 21 also limits upward movement of the top sub 12. The mandrel 40 includes an upper surface 19 of the shoulder 21 that limits downward movement top sub 12 by contacting an inside shoulder 17 of the top sub. The surfaces 17, 19 are shown more clearly in FIGS. 3 to 9.

A housing having a main body 24 and a bottom cap 36 seals an internal space of the clutch swivel against the top sub 12 and the mandrel 40 and protects components of the swivel 10 from contaminants in the production well. The housing also has an inside shoulder 49 that supports the weight of a production pump and/or other equipment that hangs underneath, and is involved in moving components of the clutch swivel 10 between different positions as described below.

The mandrel 40 might be connected to a production pump and a left hand set tension anchor, for example. A bearing or bushing 22 that in a working position sits between an inside shoulder 41 of the housing main body 24 and the outside shoulder 21 of the mandrel 40 allows easy rotation of the mandrel inside the housing.

Upper disc springs 26 have a function of resetting the collet 30 into its working position, as described below. The collet 30 has fingers 31 for engaging shoulders that define the grooves 42, 44, to thereby releasably hold the collet in either of two positions. The weight of the pump and/or other equipment hanging underneath the swivel 10 is supported in part by the collet 30. To allow movement of the top sub 12 so that its lugs 46 disengage the lugs 48 on the mandrel 40, the collet 30 releases the mandrel when a certain tension is applied to the tubing string connected to the top sub.

The lower disc springs 28 are also involved in supporting the weight of equipment hanging underneath the swivel 10, but compress enough under a certain load to allow the collet 30 to release the mandrel 40. The bottom cap 36 supports and compresses the lower spring 28 under load and also supports the weight hanging underneath the swivel 10.

Various other components are also provided in the example swivel 10 shown in FIG. 1. The upper seals 16, 20 seal the top sub 12 against the mandrel 40 and thereby seal the pressure inside the production tubing. The lower seal 38 seals the bottom cap 36 of the housing against the mandrel 40 to prevent inflow of wellbore fluids and/or other contaminants. The seals 18, 32 similarly seal an internal space of the clutch swivel 10, in which the bushing or bearing 22, the springs 26, 28, and the collet 30 are located, from contaminants in the wellbore. The seal 18 seals the main body 24 of the housing to the top sub 12, and the seal 32 seals the main body of the housing against the bottom cap 36.

Set screws 14, 34 are provided in the example shown to respectively secure the connection between the top sub 12 and the main body 24 of the housing, and the connection between the main body of the housing and the bottom cap 36 against accidental disconnection. In one embodiment, the connections between the top sub 12, main body 24 and the bottom cap 36 are threaded connections, designated generally at 15, 35 in FIG. 1, and are respectively secured against accidental disconnection by the set screws 14, 34.

The shoulder 43 of the housing main body 24, the shoulders 45, 47 of the collet 30, and the shoulder 49 of the bottom cap 36 are involved in both supporting the weight of downhole equipment and moving components of the swivel 10 between different positions. Movement of the top sub 12, and thus the housing main body 24 and the bottom cap 36, is limited by the shoulders 19, 21 of the mandrel 40 and the shoulder 17 of the top sub. These features are described in further detail below with reference to FIGS. 3 to 12. In order to avoid overly complicating these drawings, not all of the components that are labelled in FIGS. 1 and 2 have been labelled in FIGS. 3 to 12. Thus, reference numbers noted below may be found in FIGS. 1 and 2 if not in FIGS. 3 to 12.

Figure 3:
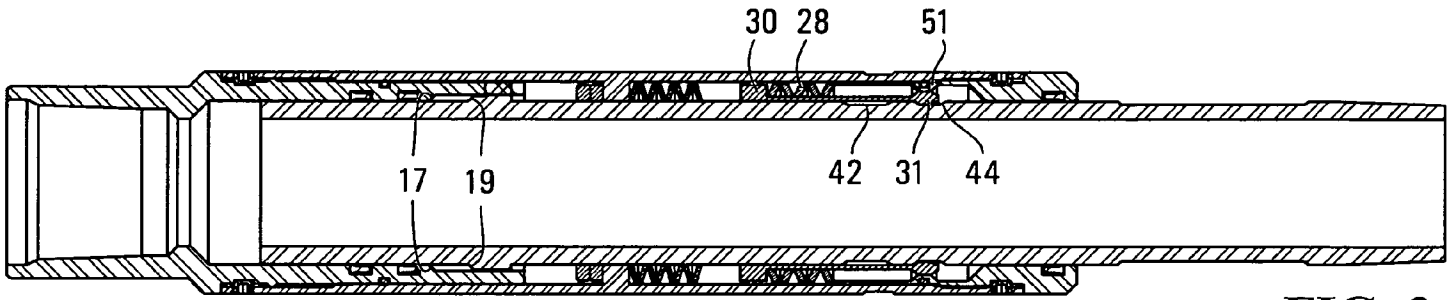
FIGS. 3 to 10 are cross-sections of the clutch swivel of FIG. 1 showing different stages of operation of the clutch swivel.

The clutch swivel 10 would be run into a well attached to a tubing string, with pumps and/or other equipment hanging underneath. The fingers 31 of the collet 30 sit in a groove 44 in the mandrel 40 and are locked in place by the inside shoulder or protrusion 51 of the bottom cap 36, as shown in FIG. 3. The weight of the equipment hanging underneath the swivel 10 is supported by the mandrel 40. The mandrel 40 is supported by the collet 30, which is in turn supported by the lower spring 28 and the top shoulder 49 of the bottom cap 36. The bottom cap 36 is connected to the housing main body 24, which is in turn connected to the top sub 12, and the top sub is connected to the tubing string. The fingers 31 of the collet 30 are held in closed position, in the groove 44, by the inside shoulder 51 of the bottom cap 36.

At this point, the lugs 46 milled in the top sub 12 are engaging the lugs 48 milled in the outside shoulder 21 of the mandrel 40, such that rotation of the tubing string will rotate the top sub and the mandrel. This position of the clutch swivel, which in some embodiments is its locked position for running in or pulling out, is also shown in the cut-away view of FIG. 11. An anchor underneath the swivel 10 can be rotated to the left to be set (i.e., attached to the casing of the well) by rotating the tubing string.

Figure 4:
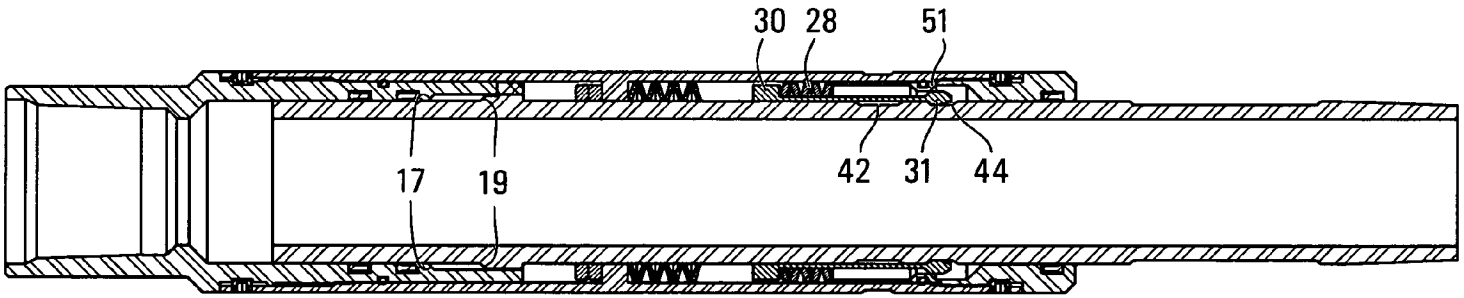
Figure 5:
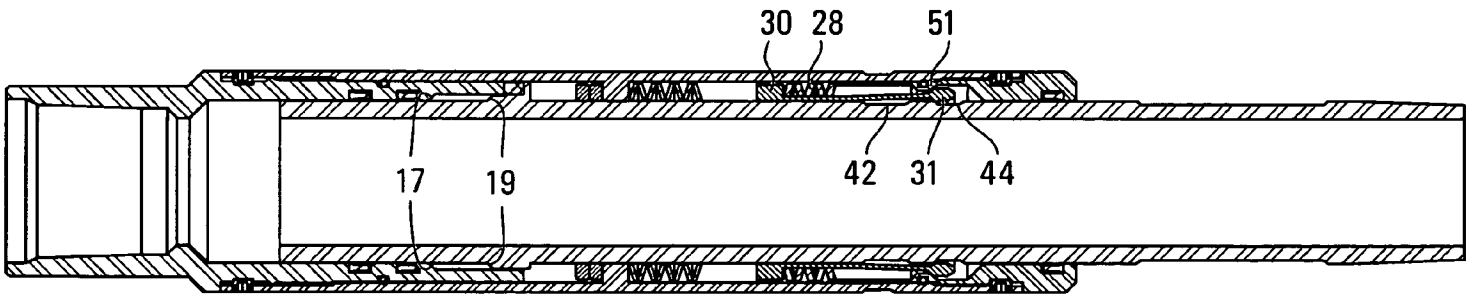

After the anchor is set by rotation and thus locked in place, tension can be pulled into the tubing string. When tension is pulled in the tubing string, the collet 30 is held in place by the mandrel 40 while the tubing is pulled upwards, and the lower spring 28 is compressed between the shoulders 47, 49 of the collet and the bottom cap 36. The bottom cap 36 and thus its shoulder 51 move upward (to the left in FIGS. 3 to 10), allowing the fingers 31 of the collet 30 to open and release the mandrel 40, as shown in FIGS. 4 and 5. Once the inside shoulder 51 of the bottom cap 36 has moved past the upper shoulder of the groove 44 on the mandrel 40, the fingers 31 of the collet 30 can open (expand outwards) to release the retaining shoulder of the groove 44 on the mandrel.

Figure 6:
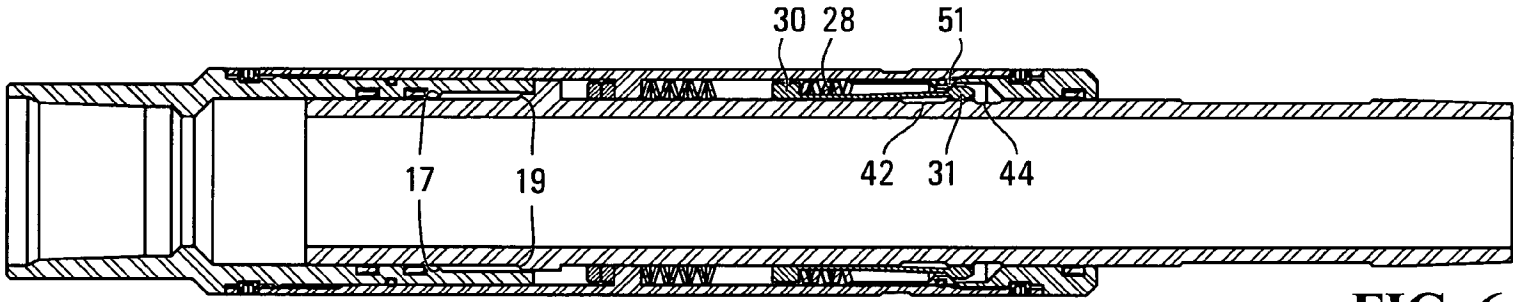

The fingers 31 of the collet 30 have completely released the shoulder of the groove 44 on the mandrel 40 in FIG. 6. The tubing string continues to be pulled upward, and with it the fingers 31 of the collet 30 travel over the upper shoulder of the groove 44 and along the mandrel 40. When the fingers 31 reach the groove 42, the compression in the spring 28 is released and the fingers 31 will retract under the shoulder 51 as shown in FIG. 7.

Figure 7:
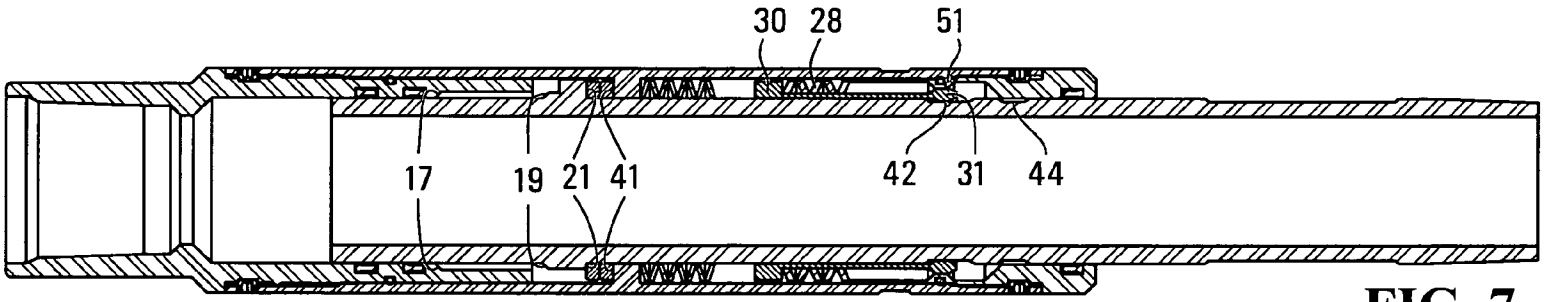

In FIG. 7, the top sub 12, the housing main body 24, the bottom cap 36, the lower spring 28, and the collet 30 have moved into their uppermost position. The bearing 22 is now locked between the upper inside shoulder 41 of the housing main body 24 and the shoulder 21 of the mandrel 40. This limits the upward movement of the top sub 12. The lugs 46 in the top sub 12 have completely disengaged the lugs 48 on the mandrel 40, and the swivel 10 is now free to rotate. This is the working position of the swivel 10, in which the top sub 12 can rotate relative to the mandrel 40, and is shown in the cut-away view of FIG. 12.

Figure 8:
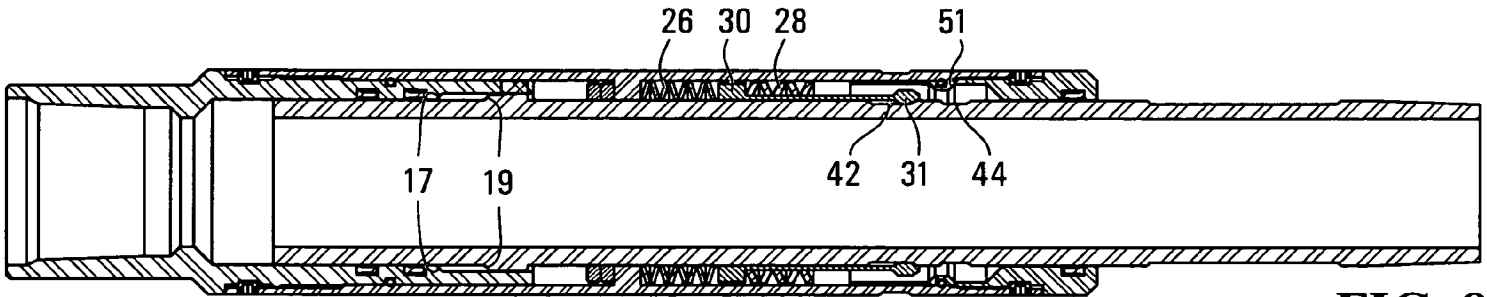

If the anchor is to be released, the tubing string is moved downward (to the right in FIGS. 8 to 10), pushing the top sub 12, the housing main body 24, the bottom cap 36 and the upper spring 26 downward, as shown in FIG. 8. The locking shoulder 51 inside the bottom cap 36 moves down from over the fingers 31 of the collet 30, and the upper spring 26 is pushed against the top shoulder 45 of the collet 30 by the shoulder 43 of the housing main body 24, forcing the fingers 31 of the collet to open and move downward to the locked position.

Figure 9:
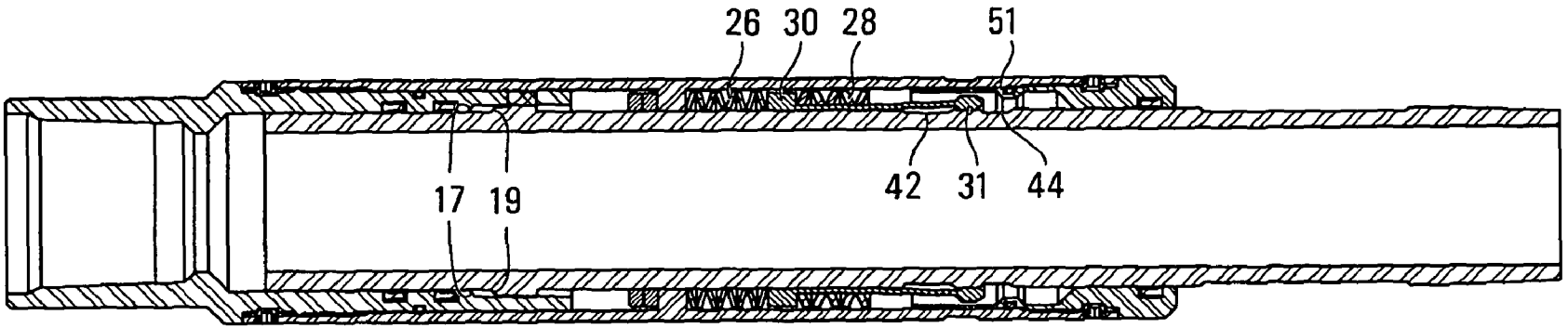

In FIG. 9, the fingers 31 of the collet 30 have expanded outward over the lower retaining shoulder of the groove 42 of the mandrel 40, and are moving downwards toward the groove 44.

Figure 10:
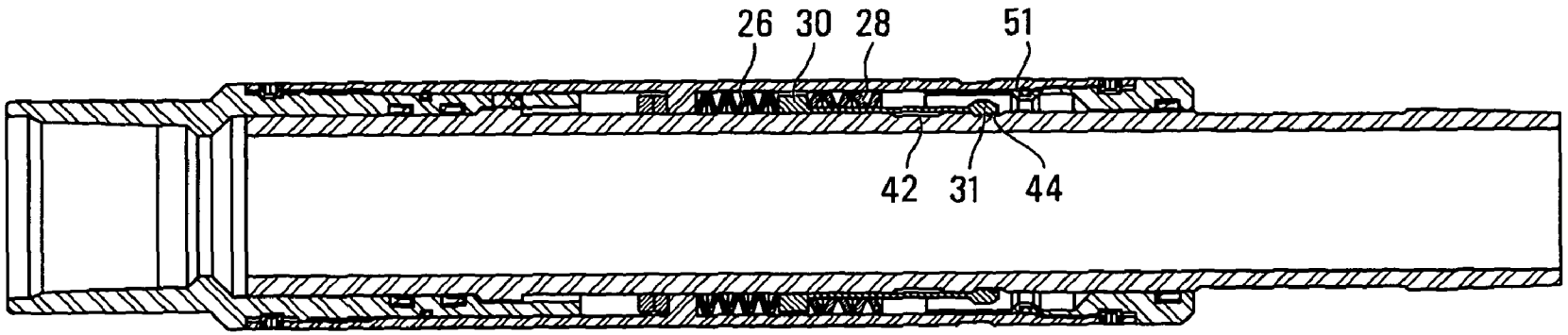
Figure 11:
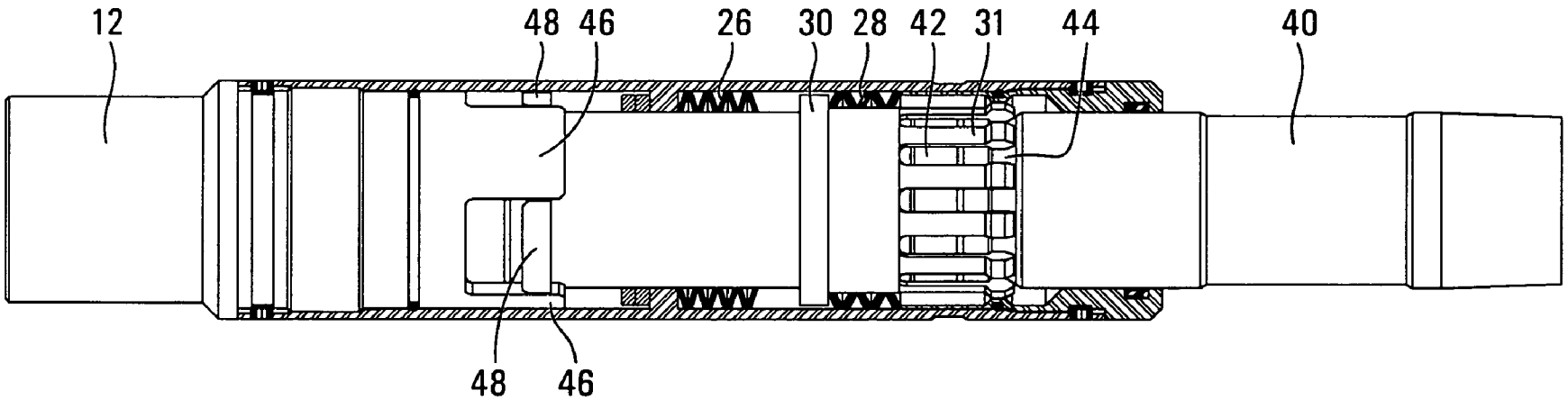
FIG. 11 is a cut-away view of the clutch swivel of FIG. 1 with the top sub in an engaged position.
Figure 12:
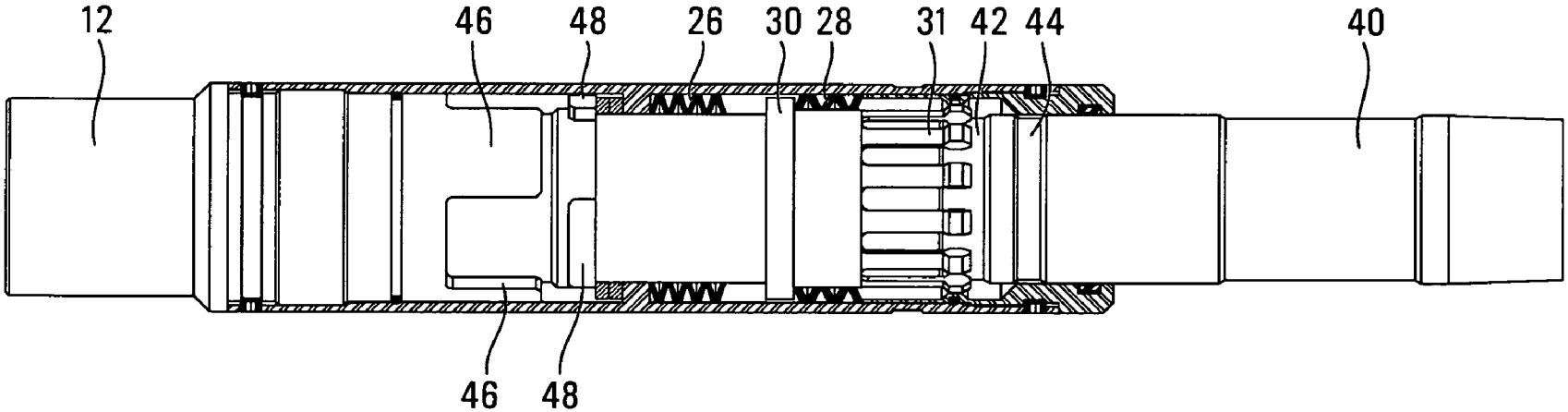
FIG. 12 is a cut-away view of the clutch swivel of FIG. 1 with the top sub in a disengaged position.

FIG. 10 shows the positions of the swivel components when the collet 30 has traveled downward to its lowest position. Further downward movement of the top sub 12 will be limited by the upper surface or shoulder 19 of the mandrel 40 and the inner surface 17 of the top sub.

The fingers 31 of the collet 30 close into the locking groove 44, and by pulling upward with the tubing string, the top sub 12, the housing main body 24, and the bottom cap 36 are moved upward to the position in FIG. 3, such that the locking shoulder 51 is again located over the fingers 31 of the collet 30, as in FIG. 3. The swivel 10 has been reset and now the anchor can be released. A left hand set anchor, for example, would be released with right hand rotation of the tubing string and the top sub 12.

If the anchor is to be set again in a different location, the tubing string does not have to be pulled all the way to surface to reset the clutch swivel, as would be the case with currently known swivels. The process outlined above can be followed as many times as needed to set, release, and reset an anchor.

It should be appreciated that FIGS. 1 to 12 represent one illustrative embodiment of the invention. Other embodiments might include fewer, further, or different components interconnected and/or arranged in a similar or different manner than shown or described. For instance, the upper spring 26 could be eliminated from the swivel 10 without significantly affecting the functions described above. Although the springs 26, 28 could be implemented using disc springs as noted above, other types of springs may be used. Further variations may be or become apparent to those skilled in the art.

More generally, an embodiment of the invention may provide a downhole resettable clutch swivel that includes a top sub for connection to a tubing string of a production well. The top sub includes a clutch mechanism, which is in the form of the lugs 46 in the example shown in FIGS. 1 to 12. A retaining arrangement releasably retains the top sub in an engaged position in which the clutch mechanism engages a mandrel to rotate the mandrel with the tubing string for setting or releasing a downhole anchor, and also allows the top sub to be moved between the engaged position and a disengaged position in which the clutch mechanism disengages the mandrel to enable the tubing string to be rotated relative to the mandrel. FIGS. 1 to 12 show the housing, collet, mandrel, and various shoulders thereon as one possible implementation of a retaining arrangement, in which the fingers 31 of the collet 30 releasably engage shoulders of the grooves 42, 44 on the mandrel 40. The groove 42 provides a recess for the fingers 31 to sit in while the tubing string is rotated.

The foregoing description relates primarily to the structure of the swivel 10 and its operation for the purposes of setting, releasing, and resetting an anchor without pulling the swivel out to the surface, and allowing a tubing string to be rotated so as to reduce wear. Another aspect of the invention relates to an internal space of the clutch swivel 10 that is sealed from the production well between the housing, the top sub 12, and the mandrel 40.

As shown most clearly in FIG. 1, the seals 18, 32 are of a common diameter. The seals 16, 20, 38 also have a common inside diameter, albeit a different diameter than the seals 18, 32 in some embodiments. As described above, the mandrel 40 may move relative to the top sub 12 and the housing. However, the housing main body 24 is connected to the top sub 12, by a threaded connection 15 secured by the set screws 14 in the example swivel 10, and the bottom cap 36 is connected to the housing main body 24 by a threaded connection 35 secured by the set screws 34. The top sub 12 and the housing thus do not move relative to each other, and accordingly the volume of the space sealed by the top sub, the housing, and the seals 16, 18, 20, 32, 38 remains constant regardless of the position of the swivel components. This constant volume configuration avoids the problem of creating changes in pressure when tension is being pulled into or released from a tubing string. Such pressure changes can introduce well fluids and/or other contaminants into a swivel.

Figure 13:
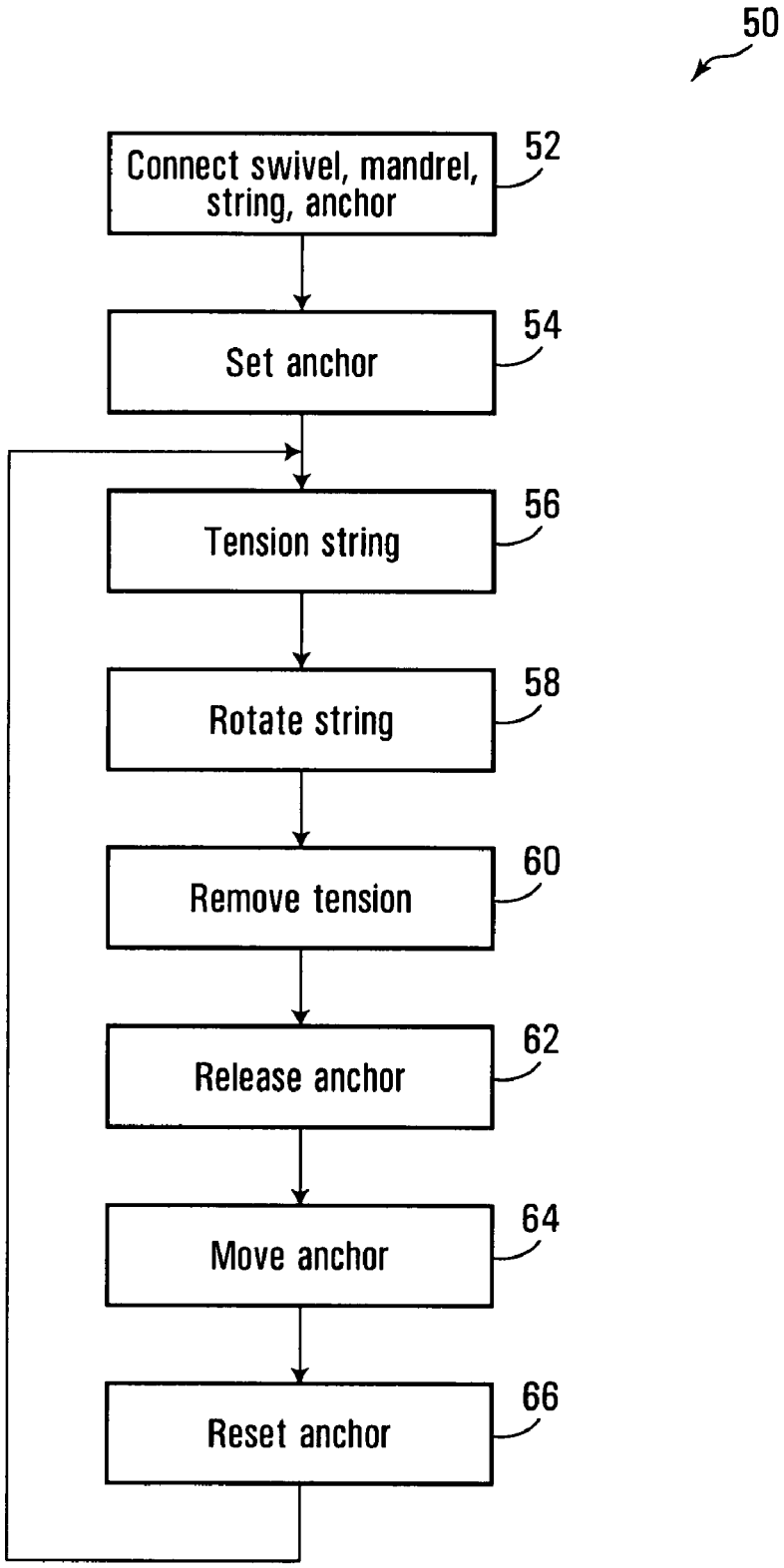
FIG. 13 is a flow diagram illustrating a method of operating a clutch swivel.

FIG. 13 is a flow diagram illustrating a method of operating a clutch swivel. The method 50 includes at 52 connecting a clutch swivel to a tubing string of a production well and to a mandrel. An anchor is also connected to the mandrel. At 54, the tubing string is rotated in a first direction with the top sub in an engaged position to set the anchor at a first downhole position in a production well. Tension is applied to the tubing string at 56 to move the top sub from the engaged position to the disengaged position. At 58, the tubing string can be rotated to distribute wear caused by contact with pump rods, for instance.

When the anchor is to be moved to a second downhole position, tension is removed from the tubing string at 60 to move the top sub from the disengaged position to the engaged position. The tubing string is rotated in a second direction opposite to the first direction with the top sub in the engaged position, to release the anchor as shown at 62. With the anchor released, the swivel and anchor, as well as any equipment connected to the anchor, is moved from the first downhole position to the second downhole position at 64. The clutch swivel, the mandrel, and the anchor remain downhole during this moving operation. The anchor is reset at the second downhole position at 66 by rotating the tubing string in the first direction with the top sub in the engaged position.

As indicated by the arrow from 66 to 56 in FIG. 13, the process of tensioning, removing tension, releasing, moving, and resetting may be repeated as many times as desired, all without pulling the swivel out the surface of a well.

Variations of the example method 50 may be or become apparent to those skilled in the art. For example, the clutch swivel might be first connected to the mandrel and then to the tubing string, with the mandrel then being connected to an anchor and other components. In some embodiments, a clutch assembly including the mandrel is connected to a tubing string and to an anchor, in this order or in a different order.

What has been described is merely illustrative of the application of principles of embodiments of the invention. Other arrangements and methods can be implemented by those skilled in the art without departing from the scope of the present invention.

We claim:

1. A downhole resettable clutch swivel comprising:

a top sub for connection to a tubing string of a production well, the top sub comprising a clutch mechanism;

a mandrel; and a retaining arrangement that:

releasably retains the top sub in an engaged position in which the clutch mechanism engages the mandrel to rotate the mandrel with the tubing string in a first direction to set a downhole anchor and to rotate the mandrel with the tubing string in a second direction opposite to the first direction to release the downhole anchor, and allows the top sub to be moved, in an axial direction along the mandrel, between the engaged position and a disengaged position in which the clutch mechanism disengages the mandrel to enable the tubing string to be rotated relative to the mandrel.

2. The clutch swivel of claim 1, wherein the clutch mechanism comprises a lug for engaging a complementary lug of the mandrel.

3. The clutch swivel of claim 1, wherein the retaining arrangement comprises a collet, the collet comprising fingers for releasably engaging a shoulder on the mandrel to retain the top sub in the engaged position.

4. The clutch swivel of claim 3, wherein the retaining arrangement further comprises a housing for sealing an internal space of the clutch swivel from the production well between the housing, the top sub, and the mandrel, the housing comprising a protrusion for releasably holding the fingers in a groove defined by the shoulder.

5. The clutch swivel of claim 4, wherein the housing comprises a bottom cap, the bottom cap comprising the protrusion.

6. The clutch swivel of claim 4, further comprising:

a first spring, disposed between a first shoulder of the housing and a first shoulder of the collet, that moves the collet from a first position in which the top sub is retained in the engaged position to a second position in which the top sub is in the disengaged position.

7. The clutch swivel of claim 6, wherein the housing comprises a bottom cap, the bottom cap comprising the first shoulder of the housing.

8. The clutch swivel of claim 6, further comprising:

a second spring, disposed between a second shoulder of the housing and a second shoulder of the collet, that moves the collet from the second position to the first position.

9. The clutch swivel of claim 1, wherein the retaining arrangement comprises a housing for sealing the clutch mechanism in an internal space of the clutch swivel from the production well between the housing, the top sub, and the mandrel.

10. The clutch swivel of claim 9, wherein a volume of the sealed internal space remains constant in the engaged position, the disengaged position, and during movement of the top sub in the axial direction along the mandrel between the engaged position and the disengaged position.

11. The clutch swivel of claim 1, further comprising:

a first spring that moves the retaining arrangement from a first position in which the top sub is retained in the engaged position to a second position in which the top sub is in the disengaged position.

12. The clutch swivel of claim 11, further comprising:

a second spring that moves the retaining arrangement from the second position to the first position.

13. A method comprising:

connecting a clutch swivel assembly to a tubing string of a production well, the clutch swivel assembly comprising a top sub for connection to the tubing string of a production well, a mandrel, and a retaining arrangement that releasably retains the top sub on the mandrel in an engaged position in which a clutch mechanism of the top sub engages the mandrel and allows the top sub to be moved between the engaged position and a disengaged position in which the clutch mechanism disengages the mandrel;

connecting an anchor to the mandrel;

rotating the tubing string in a first direction with the top sub in the engaged position to set the anchor at a first downhole position in a production well;

applying tension to the tubing string to move the top sub from the engaged position to the disengaged position;

removing tension from the tubing string to move the top sub from the disengaged position to the engaged position;

rotating the tubing string in a second direction opposite to the first direction with the top sub in the engaged position to release the anchor;

moving the anchor from the first downhole position to a second downhole position, with the clutch assembly and the anchor remaining downhole during the moving; and rotating the tubing string in the first direction with the top sub in the engaged position to reset the anchor at the second downhole position.

14. The method of claim 13, further comprising:

rotating the tubing string with the top sub in the disengaged position.

15. A downhole clutch swivel comprising:

a mandrel;

a top sub for connection to a tubing string of a production well, the top sub comprising a clutch mechanism that engages the mandrel to rotate the mandrel with the tubing string, and disengages the mandrel to enable the tubing string to be rotated relative to the mandrel; and a housing for sealing the clutch mechanism in an internal volume of the clutch swivel from the production well between the housing, the top sub, and the mandrel, the internal volume remaining constant when the top sub engages the mandrel, when the top sub disengages the mandrel, and when the top sub is moved, in an axial direction along the mandrel, between engaging and disengaging the mandrel.

16. The clutch swivel of claim 15, wherein the housing comprises respective seals for sealing the housing against the top sub and against the mandrel.

17. The clutch swivel of claim 15, wherein the housing comprises:

a main body comprising a seal for sealing the housing against the top sub; and a bottom cap comprising a first seal for sealing the bottom cap against the mandrel and a second seal for sealing the main body against the bottom cap, and wherein the top sub comprises a seal for sealing the top sub against the mandrel.

18. The clutch swivel of claim 17, further comprising:

first set screws for securing a first threaded connection between the main body and the top sub; and second set screws for securing a second threaded connection between the main body and the bottom cap.

19. The clutch swivel of claim 17, wherein the first seal of the bottom cap for sealing the bottom cap against the mandrel and the seal of the top sub for sealing the top sub against the mandrel have a common inside diameter.

* * * * *

UNITED STATES PATENT AND TRADEMARK OFFICE

CERTIFICATE OF CORRECTION

PATENT NO. : 8,069,925 B2
APPLICATION NO. : 11/983167
DATED : December 6, 2011
INVENTOR(S) : Marcel Obrejanu It is certified that error appears in the above-identified patent and that said Letters Patent is hereby corrected as shown below:

Title page, item [57] the Abstract should read as follows:

A top sub of a clutch swivel for connection to a production well tubing string is movable between an engaged position and a disengaged position relative to a mandrel. The engaged position allows an anchor to be set in a well casing by rotating the tubing string. Tension can be applied to the tubing string to move the top sub to the disengaged position, allowing the tubing string to be rotated without rotating the mandrel. The anchor can be moved to a different position, without pulling the tubing string to the surface, by removing tension from the tubing string to move the top sub from the disengaged position to the engaged position, rotating the tubing string in an opposite direction to release the anchor, and resetting the anchor by again rotating the tubing string. ~~The top sub may also include~~ In some embodiments, a sealed internal volume of the swivel remains constant ~~are~~.

Signed and Sealed this
Twenty-fifth Day of September, 2012

David J. Kappos

David J. Kappos
*Director of the United States Patent and Trademark Office*